United States Patent [19]

Ozaki et al.

[11] 4,061,472

[45] Dec. 6, 1977

[54] PROCESS FOR PRODUCING SYNTHETIC CAKING COAL AND BINDER PITCH

[75] Inventors: Hiromi Ozaki, Urawa; Mamoru Yamane, Kiyose; Hachio Kodama, Toda; Haruo Yoshika, Hoya, all of Japan

[73] Assignee: Nippon Mining Co., Ltd., Tokyo, Japan

[21] Appl. No.: 599,085

[22] Filed: July 25, 1975

Related U.S. Application Data

[63] Continuation-in-part of Ser. No. 455,363, March 27, 1974, abandoned.

[30] Foreign Application Priority Data

| | | |
|---|---|---|
| Mar. 27, 1973 | Japan | 48-34066 |
| Apr. 10, 1973 | Japan | 48-40049 |
| Apr. 26, 1973 | Japan | 48-46687 |
| Oct. 6, 1973 | Japan | 49-111951 |

[51] Int. Cl.[2] ..... C10L 9/04; C10C 1/00; C10C 3/00

[52] U.S. Cl. ..... 44/1 R; 208/40

[58] Field of Search ..... 208/4, 5, 6, 22, 43, 208/45, 46, 131, 40; 44/1 R, 1 B, 1 F

[56] References Cited

U.S. PATENT DOCUMENTS

| | | | |
|---|---|---|---|
| 2,752,290 | 6/1956 | Beattie | 208/131 |
| 3,185,635 | 5/1965 | Creglow | 44/1R |
| 3,338,817 | 8/1967 | Zrinscak et al. | 208/46 |

*Primary Examiner*—Carl F. Dees
*Attorney, Agent, or Firm*—Oblon, Fisher, Spivak, McClelland & Maier

[57] ABSTRACT

A raw synthetic caking coal having a volatile matter content of 20 - 70%, H/C (atomic ratio) of 0.60 - 1.20 and a maximum fluidity of greater than 40 ddpm is produced by coking heavy hydrocarbons. Synthetic caking coal having a volatile matter content of 20 - 40%, H/C (atomic ratio) of 0.60 - 0.75, a maximum fluidity of greater than 40 ddpm and a Free-Swelling-Index of greater than 3 is produced from the raw synthetic caking coal by stripping said raw synthetic caking coal with steam or light hydrocarbons.

6 Claims, No Drawings

PROCESS FOR PRODUCING SYNTHETIC CAKING COAL AND BINDER PITCH

CROSS REFERENCE TO RELATED APPLICATIONS

This application is a Continuation-In-Part of Application Serial No. 455,363 filed March 27, 1974, now abandoned.

BACKGROUND OF THE INVENTION

1. Field of the Invention

This invention relates to a process for producing raw synthetic caking coal having 20 – 70% volatile matter, H/C (atomic ratio) of 0.60 – 1.20 and a maximum fluidity of greater than 40 ddpm by coking heavy hydrocarbons such as atmospheric residual oil or vacuum residual oil.

This invention also relates to a process for producing synthetic caking coal having 20 – 40% volatile matter, H/C (atomic ratio) of 0.60 – 0.75, a maximum fluidity of greater than 40 ddpm and a Free-Swelling-Index of greater than 3, which can be used as a raw material in the production of metallurgical coke, by stripping the raw synthetic caking coal having 20 – 70% volatile matter with steam or light hydrocarbons. In these, the raw synthetic caking coals, especially, one having 20 – 40% volatile matter, H/C (atomic ratio) of 0.60 – 0.75 and a maximum fluidity of greater than 40 ddpm and a Free-Swelling-Index of greater than 2, can be used as raw material in the production of metallurgical coke.

2. Description of the Prior Art

The production of petroleum coke, which is characterized by high coking properties and good fluidity, from heavy hydrocarbons is not known in the prior art. Raw synthetic caking coal having 20 – 40% volatile matter, H/C (atomic ratio) of 0.60 – 0.75, a maximum fluidity of greater than 40 ddpm and a Free-Swelling-Index of greater than 2, and synthetic caking coal H/C (atomic ratio) of 0.60 – 0.75 a maximum fluidity of greater than 40 ddpm and a Free-Swelling-Index of greater than 3 having high coking properties and good fluidity which are required for producing metallurgical coke. The production of these synthetic caking coals from residual oils would be economically and environmentally desirable.

SUMMARY OF THE INVENTION

Accordingly, it is one object of the present invention to produce a raw synthetic caking coal having 20 – 70% volatile matter, H/C (atomic ratio) of 0.60 – 1.20 and a maximum fluidity of greater than 40 ddpm which can be used as a raw material in the production of synthetic caking coal.

It is another object of the present invention to produce a raw synthetic caking coal having 20 –40% volatile matter, H/C (atomic ratio) of 0.60 – 0.75, a maximum fluidity of greater than 40 ddpm and a Free-Swelling-Index of greater than 2, and a synthetic caking coal which can be used as a raw material in the production of metallurgical coke, from heavy hydrocarbons, such as petroleum residual oil.

It is another object of this invention to provide a process for coking heavy hydrocarbons to produce raw synthetic caking coal characterized by a volatile matter content of 20 – 70%, H/C(atomic ratio)of 0.60 – 1.20 and a maximum fluidity of greater than 40 ddpm, which can be used as a raw material in the production of synthetic caking coal.

It is another object of this invention to provide a process for producing synthetic caking coal having superior coking properties to a raw synthetic caking coal which can be used as a raw material in the production of metallurgical coke by stripping said raw synthetic caking coal with steam or light hydrocarbons.

These and other objects of the invention as will hereinafter become more readily understood by the following description can be attained by coking heavy hydrocarbons under relatively mild conditions, as compared to those conditions used in conventional methods for the production of petroleum coke.

DESCRIPTION OF THE PREFERRED EMBODIMENTS

In conventional coking methods for the production of petroleum coke such as the delayed coking process, a feed stock is usually heated to 485° – 510° C at the outlet of a furnace tube and is fed into a coker drum to coke the feed stock for about 16 – 32 hours. The coker drum becomes filled with a petroleum coke having a volatile matter content of less than 15% H/C (atomic ratio) of less than 0.5 no maximum fluidity and no Free-Swelling-Index. The petroleum coke produced by this conventional method has no coking property.

On the contrary, in the process of this invention, raw synthetic caking coal having 20 – 70% volatile matter, H/C (atomic ratio) of 0.60 – 1.20 and a maximum fluidity of greater than 40 ddpm, especially a raw synthetic caking coal having 20 – 40% volatile matter, H/C (atomic ratio) of 0.60 – 0.75, a maximum fluidity of greater than 40 ddpm and a Free-Swelling-Index of greater than 2 is produced which can be used as raw material in the production of metallurgical coke. The raw synthetic caking coal is obtained by employing mild coking conditions, such as coking reaction temperature of 380° – 500° C, preferably 410 to 450° C, reaction time of 0.25 – 36 hours preferably 8 – 24 hours, and pressure of 300 mmHg absolute ~6 Kg/cm² absolute, preferably 1 – 4 Kg/cm² absolute.

Raw synthetic caking coal having a volatile matter content of 20 – 70%, H/C (atomic ratio) of 0.60 – 1.20 and a maximum fluidity of greater than 40 ddpm can be easily obtained by proper selection of the reaction temperature, time and pressure.

The raw synthetic caking coal having 30.2% volatile matter, for example, exhibits a favorable free-swelling index in swelling tests as measured by Japanese Industrial Standard Test M8801-1972 and has a softening temperature of lower than 300° C, maximum fluidity above 28,000 ddpm and a solidification temperature of 528° C (as measured by Japanese Industrial Standard Test M8801-1972) H/C (atomic ratio) of 0.71 (as measured by Japanese Industrial Standard Test M8813-1963). The value for the fluidity is exceptionally good.

In the box test (Japanese Industrial Standard M8801-1972) of the raw synthetic caking coal, the Drum Index (Japanese Industrial Standard K2151-1972) of the coke prepared from the standard blend was $DI_{15}^{30}$ 92.7 and Drum Indexes of cokes prepared by substituting part natural Japanese strongly caking coal (Yubari coal) containing 15 wt. % standard blend for the raw synthetic caking coal (5 and 7 wt.%) were $DI_{15}^{30}$ 93.2 and 93.5.

The coke strength affects the production of pig iron.

A decrease of 1.0 in the Drum Index around the limit strength (coke strength when the blast volume is decreased) corresponds to a 5 - 10% decrease in the production of pig iron. Since 5% or 7% substitution of the raw synthetic caking coal having volatile matter of 20 - 40%, H/C (atomic ratio) of 0.60 - 0.75, a maximum fluidity of greater than 40 ddpm and a Free-Swelling-Index of greater than 2 for the Japanese strongly caking coal imparts superior coke strength, the advantages of the raw synthetic caking coal are evident.

The raw synthetic coal having 40 - 70% volatile matter, H/C (atomic ratio) of 0.75 - 1.20 and a maximum fluidity above 28000 ddpm has no free-swelling index by itself. It is undesirably used as a raw material in the production of metallurgical coke, because, when it is added to coal composition in the preparation of metallurgical coke and is dry-distilled, most of volatile matter will be discharged as a gas or an oil, whereupon cracking results and the coke strength is not only not improved but is decreased. However, it has high fluidity and high aromaticity as a result of thermal treatment; therefore, raw synthetic caking coal having high aromaticity can be obtained even though a vacuum residual oil having low aromaticity is used as a feed stock. Accordingly, the raw synthetic caking coal is effective as a raw material producing synthetic caking coal. On the other hand, when raw synthetic caking coal having less than 20% volatile matter is added to a composition, the free-swelling index and fluidity will be decreased. When raw synthetic caking coal, especially, having less than 15% volatile matter is added, no fluidity effect will result and its effect as a caking coal will be weak as is shown in the Reference Example below. The content of volatile matter H/C and a maximum fluidity in the raw synthetic caking coal can be selected by adjusting the temperature, time or pressure.

The characteristics of raw synthetic caking coal having 20 - 70% volatile matter, H/C (atomic ratio) of 0.60 - 1.20 and a maximum fluidity of greater than 40 ddpm produced under lower pressure are superior to those produced under higher pressures, at the same content of volatile matter. The characteristics of raw synthetic caking coal produced by coking the feed stock under a stream of inert gas or gaseous hydrocarbons are superior to those of coking without gas.

In the present invention, the feed stock can be heavy petroleum hydrocarbons such as a petroleum atmospheric or vacuum residual oil, cracked residual oil, catalytically cracked oil, propane asphalt. Raw synthetic caking coal produced from heavy hydrocarbons, is best if it contains a high percentage of aromatic compounds.

In the present invention, synthetic caking coal with a high free-swelling index of 7 can be obtained from raw synthetic caking coal having low free-swelling index of 2 by coking heavy hydrocarbons under mild conditions to obtain a raw synthetic caking coal having 40.9% volatile matter, H/C (atomic ratio) of 0.78, maximum fluidity above 28000 ddpm and subsequently stripping the raw synthetic caking coal with steam or light hydrocarbons.

The fluidity of the synthetic caking coal obtained by the stripping process is superior to that of natural caking coal.

In accordance with the present invention, as will be shown in the Examples, a typical synthetic caking coal having 25.6% volatile matter has a softening temperature of 328° C, maximum fluidity temperature of 425° C, maximum fluidity above 28,000 ddpm, solidification temperature of 517° C, according to Gieseler plastometer test (Japanese Industrial Standard M8801-1972), and H/C (atomic ratio) of 0.67.

When raw synthetic caking coal having more than 70% volatile matter is used for the stripping, most of the volatile matter is discharged by the stripping. Synthetic caking coal with desirable characteristics cannot be obtained in high yield from the residue of the stripping distillation. On the other hand, raw synthetic caking coal having less than 20% volatile matter, loses only a small amount of material in the stripping distillation. Hence, the coking property of the resulting residue decreases. Accordingly it is important that the volatile matter of the raw synthetic caking coal be in the range of 20 - 70%.

The stripping agent can be any material which is suitable for stripping low molecular material from raw synthetic caking coal, and is not limited to steam or light hydrocarbons. A large variety of synthetic caking coals can be easily produced by proper selection of stripping agents and stripping conditions.

The amount of stripping agent is usually 0.05 - 5 times as much as the amount of the raw synthetic caking coal by weight. The temperature of stripping is employed about 150° C to 450° C. It is possible to use coal tar pitch, petroleum pitch, propane asphalt, blown asphalt, or the like, as part of the raw synthetic caking coal having 20 - 70% volatile matter. In the stripping process, raw synthetic caking coal having 20 - 70% volatile matter, H/C (atomic ratio) of 0.60 - 1.20 and a maximum fluidity of greater than 40 ddpm is produced by coking heavy hydrocarbons and the resulting raw synthetic caking coal is stripped with steam or light hydrocarbons in the coker drum without removing any material from the coker drum after the reaction. The synthetic caking coal having 20 - 40% volatile matter produced by removing low molecular material (average molecular weight lower than about 400) by such stripping, is quite effective as a raw material in the production of metallurgical coke.

In the process of this invention for producing raw synthetic caking coal having 20 - 70% volatile matter, H/C (atomic ratio) of 0.60 - 1.20 and a maximum fluidity of greater than 40 ddpm, the coking temperature range may be lowered as compared to the conventional process for the production of petroleum coke, whereby carbon deposition in the heating tube, which has been a problem in the conventional coking processing, can be prevented.

The pyridine soluble components of the raw synthetic caking coal having the volatile matter of 20 - 70 wt% (H/C atomic ratio of 0.60 - 1.20; maximum fluidity of higher than 40 ddpm; are in a range of 10 - 90 wt% and have an aromaticity factor fa of 0.5 - 1.0. The pyridine soluble components of the raw synthetic caking coal having the volatile matter of 20 - 40 wt% (H/C atomic ratio of 0.60 - 0.75; maximum fluidity of higher than 40 ddpm; Free-swelling-index of higher than 2) are in a range of 10 - 50 wt% and have an aromaticity factor fa of 0.70 - 1.0. The pyridine soluble components of the synthetic caking coal having the volatile matter of 20 - 40 wt% (H/C atomic ratio of 0.60 - 0.75; maximum fluidity of higher than 40 ddpm; Free-swelling-index of higher than 3) are in a range of 10 - 50 wt% and have an aromaticity factor fa of 0.70 - 1.0.

When the pyridine soluble components are in a range of 10 - 50 wt%, a desirable caking property can be attained. The aromaticity factor fa of the pyridine soluble components is preferably high such as 0.65 - 1.0.

The raw synthetic caking coal having the volatile matter of less than 15 wt% has substantially no pyridine soluble components and cannot be used as a caking coal.

The pyridine soluble components are measured as follows:

About 5 g of the sample (a raw synthetic caking coal or a synthetic caking coal) and 50 ml of pyridine (dehydrated with NaOH) are charged in a flask and are treated under a refluxing condition for 1 hour and the solid component is separated by using a centrifugal separator at 5000 rpm for 15 minutes. The resulting pyridine solution is treated under a reduced pressure to remove pyridine and the residue is washed with 1% HCl and then with water and is dried under a reduced pressure at 100° C. The residue is measured as pyridine soluble components. An aromaticity factor fa is defined by the equation $$fa = \frac{\frac{C}{H} - \frac{1}{2}\left(\frac{H\alpha}{H}\right) - \frac{1}{2}\left(\frac{H_o}{H}\right)}{\frac{C}{H}}$$

and wherein C/H represents the ratio of carbon atoms to hydrogen atoms, $H\alpha/H$ represents the ratio of the hydrogen atoms in the $\alpha$-position of the aliphatic hydrocarbon groups attached to the aromatic rings to the total hydrogen atom content, and $H_o/H$ represents the ratio of the hydrogen atoms in the $\beta$-position or higher position of the aliphatic hydrocarbon groups attached to the aromatic rings to the total hydrogen atom content.

In the specification, the term of "raw synthetic caking coal" means "a product produced by heating heavy hydrocarbons at a temperature higher than the thermal cracking temperature."

The term of "synthetic caking coal" means "a product produced by stripping the raw synthetic caking coal."

Some of the raw synthetic caking coal itself can be used without stripping as a raw material in the production of metallurgical coke.

Having generally described the invention, a more complete understanding can be obtained by reference to certain specific examples, which are included for purposes of illustration only and are not intended to be limiting unless otherwise specified.

EXAMPLE 1

A 20 liter reactor was charged with 10 Kg of vacuum residual oil (Agha-Jari crude oil, softening temperature 38° C, pentration 252 at 25° C, Conradson carbon 14.3 wt. %). Coking of the vacuum residual oil was carried out at 420° C under atmospheric pressure for 4.5 hours, to yield 25% of a raw synthetic caking coal containing 30.2% volatile matter and having a free-swelling index (Japanese Industrial Standard M8801-1972) of 3, H/C (atomic ratio) of 0.71, a softening temperature lower than 300° C, a maximum fluidity of above 28,000 ddpm and a solidification temperature of 528° C, according to the fluidity tests on the Gieseler plastometer (Japanese Industrial Standard M8801-1972). The properties of the raw synthetic caking coal are shown in Table 1. According to the box test (Japanese Industrial Standard M8801-1972), the drum index (Japanese Industrial Standard K2151-1972) of the coke prepared from the standard blend, was $DI_{15}^{30}$ of 92.7 and those of the cokes prepared by substituting 15% natural Japanese caking coal containing raw synthetic caking coal (5% and 7%) were $DI_{15}^{30}$ of 93.2 and 93.5, respectively.

EXAMPLE 2

In the reactor of Example 1, the coking of vacuum residual oil (Kuwait crude oil, softening temperature 39° C, penetration 218 at 25° C and Conradson carbon 17.5 wt.%) was carried out at 420° C for 4 hours under absolute pressure of 300 mmHg by reducing the pressure with a vacuum pump. The reactor is equipped with an outlet for cracked oil and gas which is equipped with a condenser. The yield and properites of the resulting raw synthetic caking coal are shown in Table 1. The results of the box test are shown in Table 2.

EXAMPLE 3

The vacuum residual oil of Example 1 was heated at 410° C in furnace tubes and was fed into a 40 liter coke drum kept at 410° C skin temperature at a flow rate of 4 Kg/Hour for 20 hours. The yield and properties of the resulting raw synthetic caking coal are shown in Table 1. The results of the box test are shown in Table 2.

REFERENCE 1

The coking of the vacuum residual oil of Example 1 was carried out as in Example 1 except that the coking was conducted at 410° C under atmospheric pressure for 3 hours, to yield 40% of raw synthetic caking coal having a free-swelling index of 0, and 65.3% volatile matter and H/C (atomic ratio) of 1.16. According to the fluidity test determined by the Gieseler plastometer, the raw synthetic caking coal has softening temperature lower than 300° C and fluidity above 28,000 ddpm. The solidification temperature could not be measured because of high content of the volatile matter. The results of the box test of the standard blend conducted as in Example 3 are shown in Table 2.

REFERENCE 2

The coking of the vacuum residual oil of Example 1 was carried out as in Example 1, except that the coking was conducted at 500° C for 1.5 hours under atmospheric pressure, to yield the raw synthetic caking coal shown in Table 1. The results of the box test using the raw synthetic caking coal are shown in Table 2.

TABLE 1

| | Example | | | Reference | |
|---|---|---|---|---|---|
| Example | 1 | 2 | 3 | 1 | 2 |
| Type of feed stock | Agha-Jari vacuum residual oil 1 | Kuwait vacuum residual oil 2 | 1 | 1 | 1 |
| Coking condition | | | | | |
| Temperature | 420 | 420 | 410 | 410 | 500 |
| Pressure (mmHg abs) | 760 | 300 | 4Kg/cm² absolute | 760 | 760 |

TABLE 1-continued

| Example | Example 1 | Example 2 | Example 3 | Reference 1 | Reference 2 |
|---|---|---|---|---|---|
| Time (hr.) | 4.5 | 4 | 20 | 3 | 1.5 |
| Property of raw synthetic caking coal | | | | | |
| Yield | 25 | 28 | 38 | 40 | 22 |
| Volatile matter (%) | 30.2 | 25.2 | 39.8 | 65.3 | 12.8 |
| Free-swelling index | 3 | 8 | 2 | 0 | 0 |
| H/C (atomic ratio) | 0.71 | 0.66 | 0.77 | 1.16 | 0.53 |
| Fluidity test | | | | | |
| Softening temperature (° C) | 300> | 312 | 300> | 300> | |
| Maximum fluidity (ddpm) | 28,000< | 28,000< | 28,000< | 28,000< | No softening |
| Solidification temperature (° C) | 528 | 507 | 503 | — | |

TABLE 2

| Blend | Standard blend | 5% substitution | 7% substitution | 5% substitution | 5% substitution | 5% substitution |
|---|---|---|---|---|---|---|
| U.S. strongly coking coal | 10 | 10 | 10 | 5 | 5 | 5 |
| Other strongly coking coal | 25 | 25 | 25 | 25 | 25 | 25 |
| Semi-strongly coking coal | 32 | 32 | 32 | 32 | 32 | 32 |
| Japenese strongly coking coal | 30 | 25 | 23 | 30 | 30 | 30 |
| Petroleum coke | 3 | 3 | 3 | 3 | 3 | 3 |
| Non-caking coal | 0 | 0 | 0 | 4 | 3 | 0 |
| Raw synthetic caking coal | 0 | 5 | 7 | 1 | 2 | 5 |
| Coke strength $DI_{15}^{30}$ | | | | | | |
| Example 1 | 92.7 | 93.2 | 93.5 | | | |
| Example 2 | 92.7 | 93.9 | 93.7 | | | |
| Example 3 | 92.7 | | | 92.9 | 92.7 | |
| Reference 1 | 92.7 | | | 91.1 | 90.0 | |
| Reference 2 | 92.7 | | | — | — | 90.6 |

EXAMPLE 4

Coking of 10 kg of the vacuum residual oil of Example 1 was carried out in the 20 liter reactor at 420° C under atmospheric pressure of 4 hours, to yield 28% of raw synthetic caking coal containing 40.9% volatile matter H/C (atomic ratio) of 0.78 and having free-swelling index of 2. About 50 g of the raw synthetic caking coal was placed into a 20.0 ml vertical cylindrical type reactor which was set in a nitrate salt bath kept at 400° C. Stripping was carried out by feeding water at a rate of 200 g/hour through a pip 2 mm in diameter, which was injected from the upper flange to the bottom. The reactor was kept at 180° C during the stripping to yield 78% of the synthetic caking coal having 21.9% volatile matter, free-swelling index of 7, H/C (atomic ratio) of 0.63, softening temperature of 362° C, maximum fluidity temperature of 458° C, maximum fluidity of 275 ddpm and the solidification temperature of 508° C. The results are shown in Table 3.

EXAMPLE 5

The reactor of Example 4 was charged with 100 g of the raw synthetic caking coal of Example 4 and stripping was carried out by feeding water at a rate of 200 g/hour for 1 hour. The temperature of the reactor during the stripping was 180° C. The yield and properties of the synthetic caking coal are shown in Table 3.

EXAMPLE 6

The reactor of Example 4 was charged with 100 g of pitch having high softening temperature, which was prepared by cracking heavy petroleum hydrocarbons at higher temperature (softening temperature 250° C; volatile matter 32.0 wt.%) free-swelling index 2½ and stripping was carried out by feeding water at a rate of 200 g/hour for 1.5 hours. The temperature of the reactor during the stripping was 180° C. The results are shown in Table 3.

EXAMPLE 7

The reactor of Example 4 was charged with 100 g of the raw synthetic caking coal of Example 4 and stripping was carried out by feeding kerosene at a rate of 200 cc/hour for 1.5 hours. The temperature of the reactor during the stripping was 350° C. The results are shown in Table 3.

EXAMPLE 8

Coking of the vacuum residual oil of Example 2 was carried out as in Example 4 at 420° C under atmospheric pressure for 1 hour to yield 59% of raw synthetic caking coal having 60.7% volatile matter H/C (atomic ratio) of 1.05 and free-swelling index of 0. The reactor of Example 4 was charged with 100 g of the raw synthetic caking coal and stripping was carried out by feeding in steam at 180° C at a rate of 200 g/hour for 2 hours. The results are shown in Table 3.

| Example | Property of synthetic caking coal to stripping conditions 4 | 5 | 6 | 7 | 8 |
|---|---|---|---|---|---|
| Type of raw synthetic caking coal | Agha-Jari raw caking coal | " | Petroleum pitch | Agha-Jari raw caking coal | Kuwait raw caking coal |
| Volatile matter (%) | 40.9 | 40.9 | 32.0 | 40.9 | 60.7 |
| Free swelling index | 2 | 2 | 2½ | 2 | 0 |
| H/C (atomic ratio) | 0.78 | 0.78 | 0.62 | 0.78 | 1.05 |
| Stripping condition | steam | steam | steam | kerosene | steam |
| Flow rate g/hr to raw syntetic caking coal | 2 | 2 | 2 | 2 | 2 |
| Time (hr). | 1.5 | 1 | 1.5 | 1.5 | 2 |
| Property of synthetic caking coal | | | | | |
| Yield (%) | 78 | 84 | 95 | 88 | 47 |
| Volatile matter (%) | 21.9 | 25.6 | 28.4 | 30.2 | 30.2 |
| Free-swelling index | 7 | 5½ | 5 | 4 | 5½ |
| H/C (atomic ratio) | 0.63 | 0.67 | 0.60 | 0.71 | 0.70 |
| Fluidity test | | | | | |
| Softening temp. (° C) | 362 | 328 | 300> | 300> | 300> |
| Maximum fluidity temp. (° C) | 458 | 425 | — | — | — |
| Maximum fluidity (ddpm) | 275 | 28,000< | 28,000< | 28,000< | 28,000< |
| Solidification temp. (° C) | 508 | 517 | 524 | 519 | 520 |
| Range of plasticity (° C) | 146 | 189 | 224< | 219< | 220< |

EXAMPLE 9

Vacuum residual oil (Kuwait crude oil, specific gravity 1.0176 at 25/25° C, softening temperature 31° C, Conradson carbon 18.1%) was heated at 430° C in furnace tubes and was fed into a 20 liter coke drum kept at 430° C skin temperature at a flow rate of 5 Kg/hour for 6 hours. After feeding in the feed stock, steam heated in the furnace was passed through the drum kept at 420° C skin temperature at a flow rate of 25 Kg/hour for 4 hours to carry out the steam stripping (the temperature in the drum decreased to 380° C during the stripping). The drum was cooled to room temperature. The yield of synthetic caking coal was 30 wt.% of the residual oil and the synthetic caking coal had 25.2% volatile matter, H/C (atomic ratio) of 0.66, free-swelling index of 7, softening temperature of 312° C, the maximum fluidity above 28,000 ddpm and solidification temperature of 507° C, determined according to the fluidity test by the Gieseler plastometer. Raw synthetic caking coal produced by the same process except that no stripping was carried out, had 41% volatile matter, H/C (atomic ratio) of 0.79 and the free-swelling index of 1.

EXAMPLE 10

Vacuum residual oil (Kuwait crude oil) was fed into the reactor of Example 9 kept at 440° C skin temperature at a flow rate of 5 Kg/hour to 2 Kg/hour for 2 hours to carry out the steam stripping. The properties of the resulting synthetic caking coal are shown in Table 4. The properties of the raw synthetic caking coal produced by the same process except that no stripping was carried out, are also shown in Table 4.

EXAMPLE 11

Vacuum residual oil (Kuwait crude oil) was fed into the reactor of Example 9 kept 430° C skin temperature at a flow rate of 5 Kg/hour for 3 hours. After feeding the feed stock, steam was fed in at a flow rate of 1 Kg/hour for 1 hour, to carry out the steam stripping. The properties of the resulting synthetic caking coal are shown in Table 4. The properties of the raw synthetic caking coal produced by the same process, except that no stripping was carried out, are also shown in Table 4. According to the steam stripping from the top of the reactor, the properties of the synthetic caking coal in the drum were quite uniform.

TABLE 4

| Property of synthetic caking coal and treatment conditions | Example 9 | 10 | 11 |
|---|---|---|---|
| Raw synthetic caking coal | | | |
| Skin temperature of reactor (° C) | 430 | 440 | 430 |
| Pressure (Kg/Cm²absolute) | 1 | 1 | 1 |
| Feed rate (feed stock) (Kg/hr) | 5 | 5 | 5 |
| Feed time (hr) | 6 | 6 | 3 |
| Yield (%) | 40.8 | 30.0 | 44.8 |
| Volatile matter (%) | 41.0 | 25.8 | 48.3 |
| Free-swelling index | 1 | 3½ | 0 |
| H/C (atomic ratio) | 0.79 | 0.67 | 0.85 |
| Synthetic caking coal | | | |
| Feed rate (steam) (Kg/hr) | 2.5 | 2 | 1 |
| Steam feed time (hr) | 4 | 2 | 1 |
| Steam/raw synthetic caking coal (Kg/Kg) | 0.82 | 0.44 | 0.15 |
| Yield (%) | 30.2 | 27.5 | 38.1 |
| Volatile matter (%) | 25.2 | 22.5 | 39.6 |
| Free-swelling index | 7 | 7 | 4 |
| H/C (atomic ratio) | 0.66 | 0.63 | |
| Softening temp. (° C) | 312 | 338 | 300> |
| Maximum fluidity (ddpm) | 28,000< | 218 | 28,000< |
| Solidification temp. (° C) | 507 | 500 | 523 |
| Range of plasticity (° C) | 195 | 162 | 223< |

The pyridine soluble components and the aromaticity factors fa of the pyridine soluble components of the above-mentioned examples are shown in Table 5.

Table 5

| Example No. | raw synthetic caking coal: pyridine-soluble components (%) | raw synthetic caking coal: aromaticity factor (fa) | synthetic caking coal: pyridine-soluble components (%) | synthetic caking coal: aromaticity factor (fa) |
|---|---|---|---|---|
| 1 | 31.0 | 0.72 | | |
| 2 | 20.2 | 0.75 | a raw synthetic caking coal | |

Table 5-continued

| Example No. | raw synthetic caking coal | | synthetic caking coal | |
|---|---|---|---|---|
| | pyridine-soluble components (%) | aromaticity factor (fa) | pyridine-soluble components (%) | aromaticity factor (fa) |
| 3 | 44.8 | 0.69 | itself is used as a product. | |
| 4 | 51.0 | 0.67 | 13.8 | 0.85 |
| 5 | 51.0 | 0.67 | 21.0 | 0.78 |
| 6 | 35.2 | 0.82 | 28.1 | 0.84 |
| 7 | 51.0 | 0.67 | 30.7 | 0.74 |
| 8 | 88.8 | 0.53 | 29.5 | 0.75 |
| 9 | 52.3 | 0.65 | 22.8 | 0.80 |
| 10 | 22.0 | 0.74 | 17.3 | 0.81 |
| 11 | 67.3 | 0.62 | 48.6 | 0.70 |
| Reference No. 1 | 94.2 | 0.49 | | |
| Reference No. 2 | 0 | — | | |

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A raw synthetic caking coal prepared by thermally cracking a heavy hydrocarbon selected from the group consisting of petroleum atmospheric oil, vacuum residual oil, cracked residual oil, catalytically cracked oil, and propane asphalt at a temperature of from 380° to 500° C, which composition is characterized by a volatile matter content of from 25.2 to 60.7 percent, an atomic ratio of H/C of 0.60 to about 1.20 and a maximum fluidity greater than 40 ddpm.

2. A raw synthetic caking coal prepared by thermally cracking a heavy hydrocarbon selected from the group consisting of petroleum atmospheric oil, vacuum residual oil, cracked residual oil, catalytically cracked oil, and propane asphalt at a temperature of from 380° to 500° C, which composition is characterized by a volatile matter 25.2 to 60.7 percent, an atomic ratio of H/C of 0.60 to about 0.75, a maximum fluidity greater than 40 ddpm and a free-swelling index greater than 2.

3. A raw synthetic caking coal prepared by thermally cracking a heavy hyro carbon selected from the group consisting of petroleum atmospheric oil, vacuum residual oil, cracked residual oil, catalytically cracked oil, and propane asphalt at a temperature of from 380° to 500° C, which composition is characterized by a volatile matter content of from 25.2 to 60.7 percent, an atomic ratio of H/C of 0.60 to about 1.20 and a maximum fluidity greater than 40 ddpm and 10 to 90 wt. percent of pyridine soluble components having an aromaticity factor, fa, of 0.5 to 1.0.

4. A raw synthetic caking coal prepared by thermally cracking a heavy hydrocarbon selected from the group consisting of petroleum atmospheric oil, vacuum residual oil, cracked residual oil, catalytically cracked oil, and propane asphalt at a temperature of from 380° to 500° C, which composition is characterized by a volatile matter of from 25.2 to 60.7 percent, an atomic ratio of H/C of 0.60 to about 0.75, a maximum fluidity greater than 40 ddpm and a free-swelling index greater than 2 and 10 to 50 wt. percent of pyridine soluble components having an aromaticity factor, fa, of 0.70 to 1.0.

5. A synthetic caking coal is which is useful as a raw material in the production of metallurgical coke which is characterized by volatile matter content of 21.9 39.6% H/C (atomic ratio) of 0.60 - 0.75 a maximum fluidity above 40 ddpm and a free-swelling index of greater than 3 which is produced by stripping the raw synthetic caking coal of claim 1 with steam or a light hydrocarbon.

6. The synthetic caking coal according to claim 5, wherein said synthetic caking coal has 10 - 50 wt% of pyridine soluble components which have an aromaticity factor fa of 0.70 - 1.0.

* * * * *

UNITED STATES PATENT AND TRADEMARK OFFICE

CERTIFICATE OF CORRECTION

PATENT NO. : 4,061,472

DATED : December 6, 1977

INVENTOR(S) : Ozaki et al

It is certified that error appears in the above-identified patent and that said Letters Patent are hereby corrected as shown below:

Under the heading "[75] Inventors:", please delete "Haruo Yoshika" and insert therefor -- Haruo Yoshikai --.

Signed and Sealed this

Sixteenth Day of May 1978

[SEAL]

Attest:

RUTH C. MASON
Attesting Officer

LUTRELLE F. PARKER
Acting Commissioner of Patents and Trademarks